United States Patent [19]

Koyama et al.

[11] Patent Number: 4,956,025

[45] Date of Patent: Sep. 11, 1990

[54] PROCESS FOR PRODUCING COLD-ROLLED HIGH STRENGTH STEEL SHEET HAVING EXCELLENT FORMABILITY AND CONVERSION-TREATABILITY

[75] Inventors: Kazuo Koyama; Taketoshi Taira, both of Kimitsu; Kaoru Kawasaki, Kitakyushu; Atsushi Itami; Nobuhiko Matsuzu, both of Kimitsu, all of Japan

[73] Assignee: Nippon Steel Corporation, Tokyo, Japan

[21] Appl. No.: 292,120

[22] Filed: Dec. 30, 1988

[30] Foreign Application Priority Data

Jan. 14, 1988 [JP] Japan ..... 63-6193
Oct. 7, 1988 [JP] Japan ..... 63-252098

[51] Int. Cl.[5] ..... C21D 8/04
[52] U.S. Cl. ..... 148/12 C; 148/12 F
[58] Field of Search ..... 148/12 C, 12 F

[56] References Cited

FOREIGN PATENT DOCUMENTS 203809 12/1986 European Pat. Off. ..... 148/12 C
57-161035 10/1982 Japan .
58-100622 6/1983 Japan .
61-276925 12/1986 Japan .
61-276926 12/1986 Japan .
61-276927 12/1986 Japan .
61-276930 12/1986 Japan .
61-276951 12/1986 Japan .

*Primary Examiner*—Deborah Yee
*Attorney, Agent, or Firm*—Wenderoth, Lind & Ponack

[57] ABSTRACT

A process for producing a cold-rolled high strength steel sheet having an excellent formability and conversion-treatability, comprising the steps of: heating to a temperature of 1150° C. or lower, a steel slab comprising; 0.005 wt % or less of C, 0.5–1.5 wt % of Si, 0.1–0.5 wt % of Mn, 0.003–0.05 wt % and at least 3.4×N wt % of Ti, 0.003–0.05 wt % and at least 7.8×C wt % of Nb, 0.01–0.1 wt % of Al, 0.05–0.15 wt % of P, 0.010 wt % or less of S, 0.005 wt % or less of N, 0.0001–0.0050 wt % of B, the balance consisting of Fe and unavoidable impurities; hot-rolling the steel slab with a finishing rolling temperature of the $A_{r3}$ point of the steel or higher to obtain a hot-rolled steel sheet; cooling the hot-rolled steel sheet at a cooling rate of 10° C./sec or more in the stage between said finishing rolling and the following coiling step, with the provision that said cooling is started not later than 2 sec after the hot-rolling is finished and is continued for a duration of at least 3 sec; coiling the steel sheet at a temperature of 650° C. or higher; cold-rolling the steel sheet at a usual rolling draft; and continuous-annealing the cold-rolled steel sheet at a heat-cycle of holding for 1 sec or longer at a temperature of 930° C. or lower to complete the recrystallization of the cold-rolled steel sheet.

14 Claims, 1 Drawing Sheet

PROCESS FOR PRODUCING COLD-ROLLED HIGH STRENGTH STEEL SHEET HAVING EXCELLENT FORMABILITY AND CONVERSION-TREATABILITY

BACKGROUND OF THE INVENTION

1. Field of the Invention

The present invention relates to a process for producing a cold-rolled high strength steel sheet having an excellent formability and conversion-treatability (phosphatability and paintability), more specifically to a cold-rolled steel sheet having a high tensile strength of 40 kgf/mm$^2$ or more, a high ductility, and an excellent deep-drawability and conversion-treatability including a post-lacquering corrosion resistance (corrosion resistance of a lacquered product), and therefore suitable for use as panel members such as the outer or inner panels of automobiles, which require a good press-formability, particularly a deep-drawability, and a high strength for constructing lightweight automobiles.

2. Description of the Related Art

Steel sheet used as the panels of automobiles must have a high strength, from the viewpoint of energy saving; an excellent formability, to cope with increasing variations of automobile design; and an excellent conversion-treatability due to the necessity for a lacquering thereof.

Conventional processes for producing a cold-rolled steel sheet having an excellent deep-drawability include those disclosed, for example, in Japanese Unexamined Pat. Publication (Kokai) Nos. 61-276927(1) and 61-276930(2), which ensure a high ductility and deep-drawability by a coaddition of titanium and niobium in steel for fixing carbon, nitrogen, and sulfur to purify the inside of crystal grains.

An improvement of the conversion-treatability is described in Japanese Unexamined Pat. Publication (Kokai) Nos. 61-276951(3), 57-161035(4), 61-276925(5), 61-276926(6), and 58-100622(7).

The above publications (1) and (2) specify the heating and cooling conditions during continuous-annealing to improve the post-forming toughness (toughness of a formed product) but evaluate the property at a relatively high test temperature of −20° C., and therefore, the evaluation is not sufficiently strict. Namely, the improvement of post-forming toughness brought about by control of the heating and cooling conditions for the continuous-annealing is limited, and a further improvement cannot be derived therefrom. These publications disclose a steel sheet having a tensile strength of substantially 40 kgf/mm$^2$ or less and, therefore, do not provide a process suitable for producing a steel sheet having a tensile strength of 40 kgf/mm$^2$ or more. Moreover, when a steel sheet is to be strengthened by phosphorus and silicon additions, these publications do not disclose a way of preventing an impairment of the post-forming toughness due to the phosphorus addition or an impairment of the conversion-treatability, including the post-lacquering corrosion resistance, due to the silicon addition, although they ensure an improved strength and formability. A conversion-treatability including a post-lacquering corrosion resistance is indispensable for a steel sheet to be used in particular, as the outer panels of automobiles.

Although the publication (3) discloses a good formability and a good conversion-treatability of a silicon-added steel sheet obtained by a calcium addition, in practice it describes only a steel sheet having a silicon content of 0.02 wt % or less and a tensile strength of 32 kgf/mm$^2$ or less; i.e., it does not disclose an improvement of the conversion-treatability of a high strength steel sheet having a good formability, and further, does not mention the problem of post-lacquering corrosion resistance.

The publication (4) discloses the coating of a sulfur compound on a silicon-containing steel sheet, and mentions the problem of the post-lacquering corrosion resistance. But the treatment thereof is for a low-carbon steel containing 0.04 wt % or more carbon, and the sulfur compound coating is intended to eliminate the adverse effect of the surface carbon on the conversion-treatability. Namely, it does not discuss an ultra-low carbon steel sheet having a formability required for steel sheets for automobiles.

The publication (5) relates to an ultra-low carbon steel sheet having a specified manganese/sulfur ratio but does not relate to a high strength steel sheet, since it discusses only a silicon content of 0.1 wt % or less and a phosphorus content of 0.01 wt % or less.

The publications (6) and (7), which relate to an ultra-low carbon steel sheet and a high strength steel sheet, respectively, are disadvantageous in that a control of the dew point of the atmosphere during annealing is required.

As described above, although improvements of the formability of a high strength steel sheet and the conversion-treatability, including post-lacquering corrosion resistance, of a relatively low strength steel sheet have been established separately, the co-existence of these properties in a high strength steel sheet has not been realized due to the technological difficulties involved.

SUMMARY OF THE INVENTION

Figure 1:
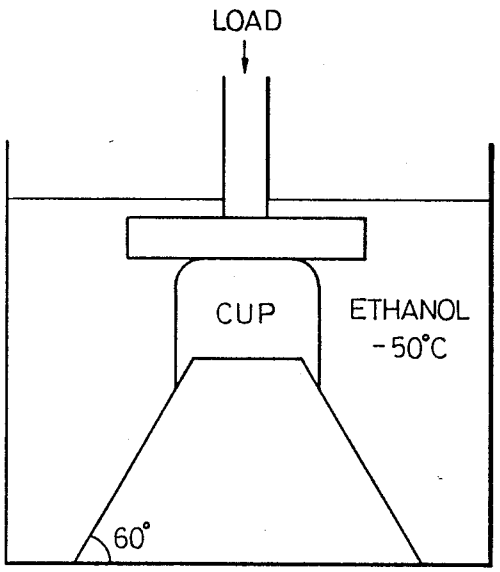
FIG. 1 schematically illustrates an arrangement for testing the post-forming toughness of a steel sheet.

The object of the present invention is to provide a process for producing a cold-rolled high strength steel sheet having an excellent formability and conversion-treatability, more specifically, a cold-rolled steel sheet having a high tensile strength of 40 kgf/mm$^2$ or more, a high ductility of 35% or more in terms of El (total elongation in tensile test), and an excellent deep-drawability of 1.6 or more in terms of $\bar{r}$, as well as an excellent conversion-treatability including a post-lacquering corrosion resistance, and therefore suitable for use as panel members, for example the outer or inner panels of automobiles, which require a good press-formability, particularly deep-drawability, and a high strength enabling the construction of light weight automobiles.

In the present invention, a large amount of silicon and phosphorus are added in an ultra-low carbon steel to increase the strength of the steel while the ductility and the deep-drawability are ensured by adding titanium and niobium in the steel at a specified amount, to completely avoid aging of the steel. The post-forming toughness, which might be otherwise impaired by the large phosphorus addition amount, is ensured by the boron addition and the conversion-treatability, which also might be impaired by the increased silicon addition amount, is ensured by the calcium addition and/or the sulfur compound coating. Accordingly, the present invention does not impose limits on the control of the atmosphere or the heating and cooling conditions during the continuous annealing.

According to the present invention, there is provided a process for producing a cold-rolled high strength steel sheet having an excellent formability and conversion-treatability, comprising the steps of:

heating a steel slab comprising

C: 0.005 wt % or less,
Si: 0.5–1.5 wt %,
Mn: 0.1–0.5 wt %,
Ti: 0.003–0.05 wt % and at least 3.4 ×N wt %,
Nb: 0.003–0.05 wt % and at least 7.8 ×C wt %,
Al: 0.01–0.1 wt %,
P: 0.05–0.15 wt %,
S: 0.010 wt % or less,
N: 0.005 wt % or less,
B: 0.0001–0.0050 wt %, the balance consisting of Fe and unavoidable impurities, to a temperature of 1150° C. or lower, hot-rolling said steel slab with a finishing rolling temperature of the $A_{r3}$ point of said steel or higher to obtain a hot-rolled steel sheet, cooling the hot-rolled steel sheet at a cooling rate of 10° C./sec or more in the stage between said finishing rolling and the following coiling step, with the provision that said cooling is started at a time not later than 2 sec after said hot-rolling is finished and is continued for a duration of at least 3 sec, coiling the steel sheet at a temperature of 650° C. or higher, cold-rolling the steel sheet at a usual rolling draft, and continuous-annealing said cold-rolled steel sheet at a heat-cycle of holding for 1 sec or longer at a temperature of 930° C. or lower to complete the recrystallization of said cold-rolled steel sheet.

DESCRIPTION OF THE PREFERRED EMBODIMENTS

The reasons for the above-specified limitations are now described.

The carbon content must be as low as possible to enhance the El and the $\bar{r}$ values, which are most essential for ensuring the formability, and must be limited to 0.005 wt % or lower, preferably 0.0025 wt % or lower. An excess carbon amount requires a large amount of niobium for fixing carbon, with the result that the amount of NbC precipitated will increase to raise the recrystallization temperature of the steel and produce a poor quality material. The current steelmaking technology could probably lower the carbon content to about 0.0005 wt %.

Silicon is essential for the present invention, to ensure a high strength, and an amount thereof of less than 0.5 wt % will not provide the high strength. Since an excess amount hardens the steel and impairs the ductility and deep-drawability thereof, the silicon content must be 1.5 wt % or less, preferably 1.0 wt % or less.

Manganese is also an essential element which helps to strengthen the steel and must be present in an amount of 0.1 wt % or more. An excess amount thereof, however, lowers the ductility and the deep-drawability, and thus the manganese content must be limited to 0.5 wt % or less.

It is known that titanium fixes sulfur, nitrogen, and carbon. Nevertheless, the amount of titanium addition must be limited within a minimum requirement for the fixing, since an excess amount leads to the formation of a TiP compound in the present inventive steel, in which phosphorus is added in a large amount, and significantly lowers the deep-drawability, and since an excess amount of solute titanium also lowers the ductility and the deep-drawability. Therefore, titanium must be added in an amount effective only for fixing nitrogen, which corresponds to about 3.4 times the amount of nitrogen present in the steel, and the upper limit of the titanium content is 0.05 wt %. An amount less than 0.003 wt % does not provide the required effect of the titanium addition.

Niobium is as essential as titanium for the present invention and fixes carbon as well as refining crystal grains during the hot-rolling. An excess amount must be avoided, to ensure a good ductility and deep-drawability, and thus niobium must be present in an amount effective only for fixing carbon, which corresponds to about 7.8 times the amount of carbon present in the steel, and the upper limit of the niobium content is 0.05 wt %. An amount less than 0.003 wt % does not provide the required effect of the niobium addition.

Aluminum is necessary for deoxidation of the steel, which improves the yield of titanium and niobium and must be present in an amount of 0.01 wt % or more. The upper limit of the aluminum content is 0.1 wt %, since an excess amount causes an increased cost of production, and forms inclusions which will remain in the steel.

Phosphorus is important for increasing the strength while ensuring the formability, since it has a greater solution-hardenability and a lesser impairment of the ductility and the deep-drawability in comparison with silicon and manganese. To ensure the strength, phosphorus must be present in an amount of 0.05 wt % or more. An excess amount thereof hardens the steel, lowers the ductility and the deep-drawability, and impairs the post-forming toughness due to the phosphorus segregation at crystal grains. Therefore, the phosphorus content must be limited to 0.15 wt % or less, preferably 0.1 wt % or less.

The sulfur content also must be as low as possible, since a higher sulfur content results in a greater amount of sulfide inclusions, which impairs the formability. Therefore, the sulfur content must be limited to 0.010 wt % or less.

The nitrogen content also must be as low as possible. Nitrogen alone is not harmful, since it is fixed by titanium before or during the hot-rolling stage but TiN, if formed in a large amount, will cause an impaired formability, and therefore, the nitrogen content must be 0.005 wt % or less, preferably 0.002 wt % or less.

Boron is necessary for improving the post-forming toughness to prevent cracking of a press-formed product under impact loading, etc., since it enhances the grain boundary strength. The present inventive steel tends to have a low strength crystal grain boundary and to suffer from a grain boundary embrittlement caused by segregation of the phosphorus added, both of which lead to an impairment of the post-forming toughness. The boron addition prevents this impairment. To provide the required effect, boron must be present in an amount of 0.0001 wt % or more. An excess amount thereof hardens the steel, to lower the formability, and does not further improve the post-forming toughness. Therefore, the boron content must be 0.0050 wt % or less, preferably 0.001 wt % or less. Such a minute addition of boron causes no significant rise of the recrystallization temperature of the steel sheet.

Calcium has an important role in the present invention when a further improved conversion-treatability is necessary. In the present invention, silicon is added to strengthen the steel matrix but an increased amount of silicon will cause the formation of silicon oxide and impair the conversion-treatability. Calcium is added to ensure a good conversion-treatability even when silicon is added at a higher level. In the present invention, the calcium addition, when combined with the sulfur compound coating which will be described later, provides a still further improved conversion-treatability, including the post-forming corrosion resistance, never before obtained. The calcium content must be 0.001 wt % or more to provide this effect. An excess amount thereof causes the formation of calcium inclusions to adversely affect the formability, and therefore, the calcium content must be 0.010 wt % or less, preferably 0.004 wt % or less.

The conditions of the heating and the subsequent steps according to the present invention are specified for the reasons given below.

The temperature of heating the steel slab according to the present invention must be 1150° C. or lower, so that nitrogen and carbon which have been fixed by titanium and niobium do not dissolve again in the steel matrix. Above the specified heating temperature range, the $\bar{r}$ value of a cold-rolled and annealed product is lowered due to a rolled texture formed during hot-rolling; probably caused by the solute niobium and titanium. The heating temperature must be high enough to ensure the finishing rolling temperature, and is preferably 1000° C. or higher.

The finishing rolling temperature is a temperature at which the last stage of hot-rolling including the last draft of hot-rolling is performed and must be the $A_{r3}$ point of the steel or higher. In ultra-low carbon steels containing niobium and titanium, such as the steel according to the invention, a remarkable rolled texture would be formed during hot-rolling and significantly affect the property of the cold-rolled and annealed product. To avoid this phenomenon, the finishing rolling temperature must be as high as possible. In practice, the operational upper limit of the finishing rolling temperature is preferably 1000° C.

With respect to the cooling after the finishing rolling, the cooling rate in the temperature range around the transformation point of the steel sheet is very important. Accordingly, the hot-rolled steel sheet must be subjected to cooling at a rate of 10° C./sec or more, not later than 2 sec after the finishing rolling and continued for at least 3 sec. This specified cooling enables an adjustment of the crystal grain size, which determines the mechanical property of a final product. Therefore, if the starting time, the duration time, and/or the rate of this cooling are outside the above specified ranges, the mechanical property of the steel sheet will be impaired. The upper limit of the duration and the cooling rate are not specified but should be practically determined so that the specified coiling temperature is ensured.

The coiling is performed at a temperature of 650° C. or higher to promote the coagulation and coarsening of the precipitates formed prior to or during hot-rolling. The coiling temperature is preferably 800° C. or lower, more preferably 700 to 750° C., from the viewpoint of the pickling of the steel sheet.

The draft of cold-rolling is preferably 50% or more, to further improve the deep-drawability.

To further improve the conversion-treatability including the post-lacquering corrosion resistance (corrosion resistance of a lacquered steel sheet), a process according to a preferred embodiment of the present invention further comprises the step of coating the surface of a cold-rolled steel sheet, prior to the continuous-annealing, with sulfur compound(s) at an amount such that the surface region of the continuous-annealed steel sheet has a sulfur content of from 0.01 to 1.0 wt %. The term "surface region" referred to herein means the region from the actual surface of a steel sheet to a depth of about 3 tm into the steel sheet thickness, since the sulfur content of a steel sheet surface is determined by an Electron Probe Micro Analyzer (EPMA).

Figure 2:
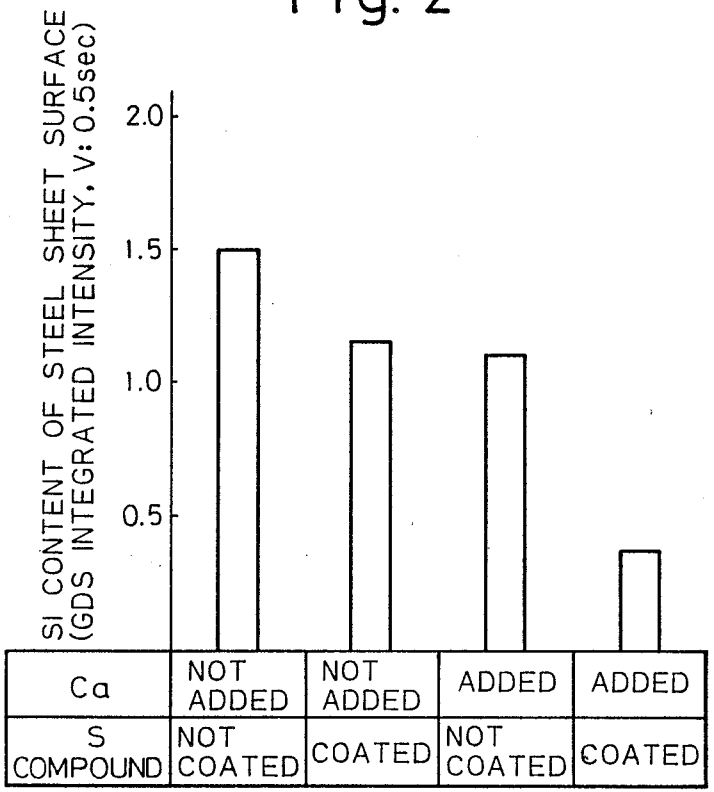
FIG. 2 is a graph showing the influence of the calcium addition and the sulfur compound coating on the silicon content of the continuous-annealed steel sheet surface.

The coating of sulfur compound(s) prior to continuous-annealing surprisingly promotes the conversion-treatability improvement effect of the calcium addition. This is believed to be caused by a reaction between the added calcium and the coated sulfur compound(s) during continuous-annealing. The sulfur compound(s) coating actually results in a reduced silicon content of the steel sheet surface, which remarkably improves the conversion-treatability. FIG. 2 shows the influence of the calcium addition and the sulfur compound(s) coating on the reduction of silicon content of the steel sheet surface. The coating treatment also improves the post-lacquering corrosion resistance (corrosion resistance of the lacquered steel sheet), which is believed to be caused by a reaction product of calcium and sulfur.

To provide this effect, the amount of sulfur compound(s) coated on the steel sheet surface must be 0.01 wt % or more in terms of the sulfur content of the continuous-annealed steel sheet surface. An amount more than 1.0 wt % thereof causes contamination of the steel sheet surface. The sulfur compound(s) is preferably coated at an amount such that the surface of the continuous-annealed steel sheet has a sulfur content of from 0.05 to 0.5 wt %.

The sulfur compounds may be coated according to the present invention by applying an aqueous solution of sulfur compound such as L-cystine, thiourea, sodium sulfite, sodium thiosulfate, and sodium sulfide or an alcoholic solution of sulfur compound such as thiophene, mercaptan, and disulfide, to the steel sheet surface. The sulfur compound may be otherwise coated by performing the cold-rolling using a rolling mill lubricant containing sulfur compound(s) and not removing the lubricant after the cold-rolling.

Continuous-annealing is performed at a heat cycle of holding the cold-rolled steel sheet for 1 sec or longer at a temperature of 930° C. or lower, to complete the recrystallization of the steel sheet. A temperature higher than 930° C. causes a coarsening of crystal grains and, in turn, a rough surface of the annealed sheet. The cooling rate from the annealing temperature need not be specified, since it does not affect the property of the steel sheet product.

An over-aging treatment of the annealed steel sheet may or may not be performed, since the present inventive steel has an ultra-low carbon content and the property thereof is not influenced by the over-aging.

A usual temper-rolling is then performed to straighten the steel sheet and/or to eliminate the yield-point elongation with the aid of skin-path rolling and/or leveling and the like, preferably at a temper-rolling reduction in the range of from 0.1% to 1.5%.

EXAMPLES

Example 1

Steel A of Table 1 was melted in a convertor, RH-degassed, and continuous-cast to obtain steel slabs, which were then heated, hot rolled, cooled, and coiled under the conditions as summarized in Table 2. The thus obtained steel sheets were then pickled, and cold-rolled at a draft of 83% to a thickness of 0.8 mm. The cold-rolled steel sheets were subjected to continuous-annealing at 850° C. for 1.5 min followed by a temper-rolling at a reduction of 0.8%.

To evaluate the property of the thus obtained steel sheets, a tensile test was carried out according to the JIS Z 2241 method by using a JIS Z 2201 No. 5 test piece. To evaluate the post-forming toughness, cylindrical cup test pieces deep-drawn from a 100 mm dia. cut sheet sample at a drawing ratio of 2.0 were expanded on a tapered punch by applying a load in an ethanol bath at a temperature of −50° C. as shown in FIG. 1, and the occurrence of brittle cracking was checked and classified as follows:

o: no brittle cracking observed, and x: brittle cracking observed.

The results thus obtained are also summarized in Table 2.

The result shows that all samples have a tensile strength higher than 40 kgf/mm$^2$ and that sample Nos. 3, 4, 5, 8, 9, 10, 13, and 14 processed according to the present invention have an El value greater than 35% and an $\bar{r}$ value greater than 1.6. Sample Nos. 1 and 6 processed under a finishing rolling temperature lower than the $A_{r3}$ point contain a mixed grain structure and have poor El and $\bar{r}$ values. Sample Nos. 2 and 7 processed under a coiling temperature lower than 650° C. contain precipitates, are insufficiently coagulated and coarsened, and have poor El and $\bar{r}$ values. Sample No. 11 processed under a heating temperature higher than 1150° C. has poor El and $\bar{r}$ values, respectively, due to a predominant rolled-texture and fine precipitates formed during hot-rolling. Sample Nos. 12 and 15 processed under an unsuitable cooling condition after hot-rolling have poor El and/or $\bar{r}$ values.

The result also shows that all samples have a good post-forming toughness.

Example 2

Steel B of Table 1 was melted in a converter, RH-degassed, and continuous-cast to obtain a steel slab, which was then heated to 1050° C., hot rolled with a finishing rolling temperature of 950° C., cooled at a cooling rate of 32° C./sec from the time 1.5 sec after the finishing rolling for a duration of 4 sec, and coiled at 750° C. The thus obtained steel sheets were then pickled, and cold-rolled at a draft of 80%. After an electric cleaning treatment, an aqueous solution of 5000 ppm thiourea was applied to the cold-rolled steel sheets, which were then subjected to continuous-annealing for 1.5 min at various temperatures shown in Table 3, followed by a temper rolling at a reduction of 0.5%. The sulfur content of the steel sheet surface at this stage was measured as 0.05 wt %, by an Electron Probe Micro-Analyzer (EPMA).

The tensile property and the post-forming toughness were determined by the same procedures as described in Example 1. The conversion-treatability was evaluated by determining the phosphate crystal grain size and the coating adherence by using a conventional dip-type bonderizing solution, and the results were classified as follows:

oo: Steel sheet surface is completely covered with phosphate crystals having a uniform grain size of 5 μm or less, o: phosphate crystals have non-uniform grain sizes and less than 1% of the steel sheet surface is not covered, Δ : major number of phosphate crystals have a grain size of 10 μm or more and 50 to 99% of the steel sheet surface is covered, and x: less than 50% of the steel sheet surface is covered with phosphate crystals.

The post-lacquering corrosion resistance was also studied by a 1000-hour salt-water spraying test of the steel sheets which had been subjected to a conversion-treatment and then lacquering by a cation-type electro-deposition. The post-lacquering corrosion resistance was evaluated with the swelling width of the lacquer coating at cross-cuts formed thereon prior to the test, and classified as follows:

| symbols | swelling width |
|---|---|
| oo | less than 2 mm |
| o | 2 to 4 mm |
| Δ | 4 to 6 mm |
| x | more than 6 mm |

The results thus obtained are also shown in Table 3.

The El and the $\bar{r}$ values exceed 35% and 1.6, respectively, for samples U, V, W, X, Y, and Z, which were annealed at temperatures of 800° C. or higher. Sample X annealed at 900° C. has a slightly rough surface, which in practice is no trouble. An annealing temperature higher than 930° C. causes an impaired tensile property due to a coarsened crystal grains, as evidenced by sample Z annealed at 935° C. Samples S and T annealed at temperatures lower than 800° C., respectively, are insufficiently recrystallized and hard, with resulting poor El and $\bar{r}$ values. All samples have a good conversion-treatability including post-lacquering corrosion resistance, especially for samples subjected to the sulfur compound coating, and have a good post-forming toughness.

Example 3

Steels C to R of Table 1 were melted in a converter, RH-degassed, and continuous-cast to obtain steel slabs, which were then heated to 1050° C., hot rolled with a finishing rolling temperature of 950° C., cooled at a cooling rate of 32° C./sec from a time 1.5 sec after the finishing-rolling, for a duration of 4 sec, and coiled at 750° C. The thus obtained steel sheets were then pickled, and cold-rolled at a draft of 80%. After an electric cleaning treatment, an aqueous solution of 10000 ppm thiourea was applied to the cold-rolled steel sheets, which were then subjected to continuous-annealing at 850° C. for 1.5 min, during the cooling stage of which the steel sheets were held at 350° C. for 5 min to effect an over-aging treatment, followed by a temper rolling at a reduction of 0.5%. The sulfur content of the steel sheet surface at this stage, as determined by EPMA, varied from 0.09 to 0.15 wt %.

The tensile property, the conversion-treatability including post-lacquering corrosion resistance, and the post-forming toughness were determined by the same procedure as described in Examples 1 and 2. The results thus obtained are also shown in Table 4.

Steel sheets C to G according to the present invention have an excellent tensile property, post-forming toughness, and post-lacquering corrosion resistance. Steel sheet H according to the present invention, with no Ca addition, has a conversion treatability and a post-lacquering corrosion resistance at a level classified by "o", which in practice is no trouble. Steel sheet I according to the present invention and containing silicon in a rather higher amount than the steel sheet A, for example, has a conversion coating coverage of 96% (denoted by "Δ"), which in practice is no trouble.

Steel sheet J, with no boron addition, has a poor post-forming toughness. Steel sheet K contains carbon and nitrogen in excessive amounts giving rise to yield-point elongation as well as hardening of the steel sheet, with resulting poor El and $\bar{r}$ values. Steel sheet L contains silicon, manganese, and phosphorus in amounts less than the specified range and has a poor strength. Steel sheet M contains silicon in an excess amount and has a poor conversion-treatability, regardless of the calcium addition. Steel sheet N contains manganese in an excess amount, which hardens the steel sheet, and has poor El and $\bar{r}$ values. Steel sheet O, which contains titanium in an insufficient amount with respect to the N content, has a poor $\bar{r}$ value due to a rise of the yield-point elongation. Steel sheet P has poor El and $\bar{r}$ values due to hardening and the TiP formation caused by excess amounts of titanium and niobium. Steel sheets Q, which contains excessive calcium, has a poor El value and poor post-forming toughness, due to the formation of calcium inclusions. Steel sheets R contains excessive boron, which hardens the steel sheet, and has poor El and $\bar{r}$ values.

As described above, the present invention provides a process for producing a cold-rolled high strength steel sheet having an excellent formability and post-forming toughness, despite the high strength, as well as an excellent conversion-treatability including post-lacquering corrosion resistance, and is particularly suitable for use as the outer panels of automobiles and the like, and thereby enables a solution to the current problems of automobile production, i.e., to produce automobile bodies of lighter weight, higher grade, and various designs.

TABLE 1

| No. | C | Si | Mn | P | S | Al | N | Ti | Nb | B | Ca | (in wt %) |
|---|---|---|---|---|---|---|---|---|---|---|---|---|
| A | 0.0021 | 0.79 | 0.23 | 0.072 | 0.005 | 0.038 | 0.0031 | 0.017 | 0.040 | 0.0005 | — | Invention |
| B | 0.0018 | 0.77 | 0.32 | 0.088 | 0.003 | 0.034 | 0.0020 | 0.012 | 0.033 | 0.0004 | 0.0028 | " |
| C | 0.0026 | 0.89 | 0.48 | 0.083 | 0.008 | 0.034 | 0.0022 | 0.011 | 0.030 | 0.0004 | 0.0020 | " |
| D | 0.0020 | 1.15 | 0.35 | 0.060 | 0.005 | 0.038 | 0.0025 | 0.025 | 0.029 | 0.0003 | 0.0012 | " |
| E | 0.0012 | 0.78 | 0.39 | 0.081 | 0.002 | 0.042 | 0.0027 | 0.015 | 0.025 | 0.0006 | 0.0020 | " |
| F | 0.0045 | 0.80 | 0.21 | 0.055 | 0.006 | 0.032 | 0.0015 | 0.012 | 0.037 | 0.0004 | 0.0031 | " |
| G | 0.0015 | 0.65 | 0.33 | 0.084 | 0.005 | 0.035 | 0.0022 | 0.022 | 0.020 | 0.0002 | 0.0011 | " |
| H | 0.0023 | 0.88 | 0.45 | 0.071 | 0.005 | 0.035 | 0.0025 | 0.021 | 0.022 | 0.0005 | — | " |
| I | 0.0021 | 1.22 | 0.25 | 0.078 | 0.005 | 0.031 | 0.0021 | 0.011 | 0.021 | 0.0005 | — | " |
| J | 0.0015 | 0.87 | 0.31 | 0.068 | 0.005 | 0.029 | 0.0022 | 0.015 | 0.025 | — | 0.0022 | Comparison |
| K | 0.0077 | 0.52 | 0.33 | 0.059 | 0.004 | 0.035 | 0.0088 | 0.022 | 0.052 | 0.0005 | 0.0022 | " |
| L | 0.0022 | 0.44 | 0.05 | 0.022 | 0.008 | 0.035 | 0.0024 | 0.022 | 0.033 | 0.0002 | 0.0025 | " |
| M | 0.0035 | 1.65 | 0.33 | 0.085 | 0.005 | 0.042 | 0.0021 | 0.022 | 0.028 | 0.0005 | 0.0019 | " |
| N | 0.0042 | 0.88 | 0.95 | 0.087 | 0.004 | 0.044 | 0.0033 | 0.022 | 0.033 | 0.0005 | 0.0015 | " |
| O | 0.0041 | 0.74 | 0.42 | 0.088 | 0.005 | 0.039 | 0.0049 | 0.012 | 0.033 | 0.0005 | 0.0025 | " |
| P | 0.0023 | 0.81 | 0.34 | 0.066 | 0.005 | 0.042 | 0.0022 | 0.068 | 0.061 | 0.0004 | 0.0017 | " |
| Q | 0.0033 | 0.90 | 0.51 | 0.070 | 0.005 | 0.032 | 0.0025 | 0.019 | 0.027 | 0.0006 | 0.0125 | " |
| R | 0.0026 | 0.71 | 0.62 | 0.078 | 0.006 | 0.038 | 0.0021 | 0.015 | 0.025 | 0.0057 | 0.0022 | " |

Note:
Underlined data are outside the specified range of the present invention.

TABLE 2

| No. | HT | FT | T | To | CR | CT | YP | TS | El | $\bar{r}$ | Post-Forming Toughness | |
|---|---|---|---|---|---|---|---|---|---|---|---|---|
| 1 | 1050 | 845 | 4 | 1.5 | 32 | 730 | 25.9 | 47.2 | 32.5 | 1.49 | o | Comparison |
| 2 | 1050 | 940 | 4 | 1.5 | 32 | 550 | 25.7 | 46.8 | 32.9 | 1.42 | o | Comparison |
| 3 | 1050 | 950 | 4 | 1.5 | 32 | 750 | 23.9 | 45.9 | 40.2 | 1.79 | o | Invention |
| 4 | 1050 | 920 | 4 | 0.5 | 32 | 760 | 23.5 | 45.8 | 39.5 | 1.98 | o | Invention |
| 5 | 1050 | 980 | 4 | 1.5 | 32 | 740 | 23.7 | 46.1 | 41.9 | 1.80 | o | Invention |
| 6 | 1100 | 880 | 4 | 1.5 | 32 | 760 | 25.9 | 47.2 | 32.9 | 1.49 | o | Comparison |
| 7 | 1100 | 930 | 4 | 1.5 | 32 | 600 | 25.5 | 46.9 | 33.2 | 1.55 | o | Comparison |
| 8 | 1100 | 930 | 4 | 1.5 | 32 | 750 | 24.5 | 45.9 | 37.1 | 1.69 | o | Invention |
| 9 | 1100 | 950 | 4 | 1.5 | 32 | 730 | 25.1 | 46.3 | 38.2 | 1.72 | o | Invention |
| 10 | 1100 | 970 | 4 | 1.5 | 32 | 720 | 24.8 | 45.7 | 37.0 | 1.78 | o | Invention |
| 11 | 1175 | 950 | 4 | 1.5 | 32 | 720 | 26.9 | 47.0 | 32.2 | 1.54 | o | Comparison |
| 12 | 1100 | 920 | 1 | 1.5 | 32 | 720 | 24.2 | 45.5 | 34.5 | 1.51 | o | Comparison |
| 13 | 1100 | 920 | 4 | 1.5 | 17 | 720 | 25.0 | 44.7 | 36.2 | 1.70 | o | Invention |
| 14 | 1100 | 925 | 4 | 1.5 | 51 | 700 | 24.1 | 43.2 | 39.5 | 1.79 | o | Invention |

TABLE 2-continued

| No. | HT | FT | T | To | CR | CT | YP | TS | El | $\bar{r}$ | Post-Forming Toughness | |
|---|---|---|---|---|---|---|---|---|---|---|---|---|
| 15 | 1100 | 920 | 4 | 4.5 | 32 | 720 | 24.1 | 44.8 | 35.9 | 1.55 | o | Comparison |

Note:
HT: Heating Temperature (°C.)
FT: Finishing Rolling Temperature (°C.)
T: Duration of Cooling (sec)
To: Time Elapsed before Start of Cooling (sec)
CR: Cooling Rate within Duration Time (°C./sec)
YP, TS: Yield Point and Tensile Strength (kgf/mm$^2$)
El: Elongation (%)
Underlined data are outside the specified range of the present invention.

TABLE 3

| No. | Sulfur Compound | Annealing Temperature | YP | TS | El | $\bar{r}$ | Conversion Treatability | Post-Lacquering Corrosion Resistance | Post-Forming Toughness | |
|---|---|---|---|---|---|---|---|---|---|---|
| S | Not Coated | 700 | 33.2 | 52.0 | 22.9 | 1.07 | o | o | o | Comparison |
| T | Not Coated | 750 | 28.6 | 47.6 | 29.9 | 1.52 | o | o | o | Comparison |
| U | Coated | 800 | 26.2 | 46.5 | 36.6 | 1.81 | oo | oo | o | Invention |
| V | Coated | 850 | 25.4 | 46.1 | 38.2 | 2.01 | oo | oo | o | Invention |
| W | Not Coated | 850 | 25.5 | 46.2 | 38.0 | 2.01 | o | o | o | Invention |
| X | Not Coated | 900 | 23.4 | 44.5 | 39.5 | 2.21 | o | o | o | Invention |
| Y | Coated | 900 | 23.1 | 44.0 | 39.8 | 2.23 | oo | oo | o | Invention |
| Z | Not Coated | 935 | 22.0 | 39.5 | 35.2 | 1.81 | o | o | o | Comparison |

Unit:
Annealing Temperature: °C.
YP, TS: kgf/mm$^2$
El: %

TABLE 4

| No. | YP | YP-El | TS | El | $\bar{r}$ | Conversion Treatability | Post-Lacquering Corrosion Resistance | Post-Forming Toughness | |
|---|---|---|---|---|---|---|---|---|---|
| C | 24.3 | 0 | 46.2 | 38.5 | 1.82 | oo | oo | o | Invention |
| D | 25.5 | 0 | 47.1 | 37.5 | 1.80 | o | o | o | " |
| E | 23.9 | 0 | 43.9 | 41.2 | 2.01 | oo | oo | o | " |
| F | 26.8 | 0 | 48.2 | 36.2 | 1.75 | oo | oo | o | " |
| G | 24.3 | 0 | 47.0 | 38.9 | 1.82 | oo | oo | o | " |
| H | 22.9 | 0 | 44.2 | 39.5 | 1.89 | o | o | o | " |
| I | 25.9 | 0 | 49.0 | 36.1 | 1.71 | Δ | o | o | " |
| J | 26.2 | 0 | 47.1 | 34.5 | 1.75 | oo | oo | x | Comparison |
| K | 26.9 | 1.2 | 49.2 | 31.0 | 1.57 | oo | oo | o | " |
| L | 21.9 | 0 | 36.2 | 41.2 | 1.86 | oo | oo | o | " |
| M | 33.2 | 0 | 53.6 | 25.6 | 1.69 | x | x | o | " |
| N | 32.5 | 0 | 52.1 | 26.5 | 1.53 | oo | oo | o | " |
| O | 28.5 | 0.2 | 47.1 | 34.2 | 1.56 | oo | oo | o | " |
| P | 26.1 | 0 | 49.2 | 34.2 | 1.39 | oo | oo | o | " |
| Q | 25.2 | 0 | 46.8 | 32.1 | 1.60 | oo | oo | x | " |
| R | 32.1 | 0 | 48.5 | 28.1 | 1.40 | oo | oo | o | " |

Unit . . . YP, TS: kgf/mm$^2$
YP-El, El: %

We claim:

1. A process for producing a cold-rolled high strength steel sheet having an excellent formability and conversion-treatability, comprising the steps of:

heating to a temperature of 1150° C. or lower a steel slab comprising

C: 0.005 wt % or less,
Si: 0.5–1.5 wt %,
Mn: 0.1–0.5 wt %,
Ti: 0.003–0.05 wt % and at least 3.4×N wt %,
Nb: 0.003–0.05 wt % and at least 7.8×C wt %,
Al: 0.01–0.1 wt %,
P: 0.05–0.15 wt %,
S: 0.010 wt % or less,
N: 0.005 wt % or less,
B: 0.0001–0.0050 wt %,
the balance consisting of Fe and unavoidable impurities, hot-rolling said steel slab with a finishing rolling temperature of the $A_{r3}$ point of said steel or higher to obtain a hot-rolled steel sheet, cooling the hot-rolled steel sheet at a cooling rate of 10° C./sec or more in the stage between said finishing rolling and the following coiling step, with the provision that said cooling is started not later than 2 sec after said hot-rolling is finished and is continued for a duration of at least 3 sec, coiling the steel sheet at a temperature of 650° C. or higher, cold-rolling the steel sheet at an ordinary rolling draft, coating the surface of the cold-rolled steel sheet with one or more sulfur compounds in an amount such that after the following continuous-annealing step the surface of the continuous-annealed steel sheet has a sulfur content of from 0.01 to 1.0 wt %, and continuous-annealing said cold-rolled steel sheet at a heat-cycle of holding for 1 sec or longer at a temperature of 930° C. or lower to complete the recrystallization of said cold-rolled steel sheet.

2. A process according to claim 1, wherein said steel slab further comprises Ca in an amount of 0.001 to 0.010 wt %.

3. A process according to claim 2, wherein said steel slab contains Ca in an amount of from 0.001 to 0.004 wt %.

4. A process according to claim 1, wherein one or more sulfur compounds are coated in an amount such that the surface of said continuous-annealed steel sheet has a sulfur content of from 0.05 to 0.5 wt %.

5. A process according to claim 1, wherein said steel slab contains

C: 0.0025 wt % or less,
Si: 0.5–1.0 wt %,
P: 0.05–0.1 wt %,
N: 0.002 wt % or less, and
B: 0.0001–0.0010 wt %.

6. A process according to claim 4, wherein said steel slab contains

C: 0.0025 wt % or less,
Si: 0.5–1.0 wt %,
P: 0.05–0.1 wt %,
N: 0.002 wt % or less, and
B: 0.0001–0.0010 wt %.

7. A process according to one of claim 1, wherein said heating of said steel slab is performed at a temperature of from 1000° to 1150° C., the finishing rolling of said hot-rolling is performed at a temperature of from the $A_{r3}$ point of said steel to 1000° C., said coiling is performed at a temperature of from 650° to 800° C., and said cold-rolling is performed at a rolling draft of 50% or more.

8. A process according to claim 7, wherein said coiling is performed at a temperature of from 700° to 750° C.

9. A process according to claim 4, wherein said heating of said steel slab is performed at a temperature of from 1000° to 1150° C., the finishing rolling of said hot-rolling is performed at a temperature of from the $A_{r3}$ point of said steel to 1000° C., said coiling is performed at a temperature of from 650° to 800° C., and said cold-rolling is performed at a rolling draft of 50% or more.

10. A process according to claim 9, wherein said coiling is performed at a temperature of from 700° to 750° C.

11. A process according to claim 2, wherein said steel slab contains;

C: 0.0025 wt % or less,
Si: 0.05–1.0 wt %,
P: 0.5–1.0 wt %,
N: 0.002 wt % or less, and
B: 0.0001–0.0010 wt %.

12. A process according to claim 3, wherein said steel slab contains;

C: 0.0025 wt % or less,
Si: 0.5–1.0 wt %,
P: 0.5–1.0 wt %,
N: 0.002 wt % or less, and
B: 0.0001–0.0010 wt %.

13. A process according to claim 2, wherein said heating of said steel slab is performed at a temperature of from 1000° to 1150° C., the finishing rolling of said hot-rolling is performed at a temperature of from the $A_{r3}$ point of said steel to 1000° C., said coiling is performed at a temperature of from 650° to 800° C., and said cold-rolling is performed at a rolling draft of 50% or more.

14. A process according to claim 3, wherein said heating of said steel slab is performed at a temperature of from 1000° to 1150° C., the finishing rolling of said hot-rolling is performed at a temperature of from the $A_{r3}$ point of said steel to 1000° C., said coiling is performed at a temperature of from 650° to 800° C., and said cold-rolling is performed at a rolling draft of 50% or more.

* * * * *